US008074903B2

(12) United States Patent
Venkataraghavan et al.

(10) Patent No.: US 8,074,903 B2
(45) Date of Patent: Dec. 13, 2011

(54) STATOR ASSEMBLY AND FUEL INJECTOR USING SAME

(75) Inventors: Jayaramanaraman K. Venkataraghavan, Dunlap, IL (US); Stephen R. Lewis, Chillicothe, IL (US); Shriprasad Lakhapati, Peoria, IL (US); Avinash R. Manubolu, Edwards, IL (US); Nadeem N. Bunni, Cranberry Township, PA (US)

(73) Assignee: Caterpillar Inc., Peoria, IL (US)

( * ) Notice: Subject to any disclaimer, the term of this patent is extended or adjusted under 35 U.S.C. 154(b) by 234 days.

(21) Appl. No.: 12/319,838

(22) Filed: Jan. 13, 2009

(65) Prior Publication Data

US 2010/0176223 A1 Jul. 15, 2010

(51) Int. Cl.

| | |
|---|---|
| ***F02M 51/06*** | (2006.01) |
| ***F02M 53/04*** | (2006.01) |
| ***F02M 51/00*** | (2006.01) |
| ***B05B 1/30*** | (2006.01) |

(52) U.S. Cl. ..... 239/585.2; 239/132; 239/585.1

(58) Field of Classification Search ..... 239/132, 239/132.1, 132.3, 585.1–585.5; 251/129.01, 251/129.15, 129.16, 129.21, 129.22
See application file for complete search history.

(56) References Cited

U.S. PATENT DOCUMENTS

| | | | | |
|---|---|---|---|---|
| 4,805,837 | A * | 2/1989 | Brooks et al. | 239/125 |
| 4,883,252 | A | 11/1989 | Mesenich | |
| 4,984,549 | A | 1/1991 | Mesenich | |
| 5,168,857 | A | 12/1992 | Hickey | |
| 5,235,954 | A | 8/1993 | Sverdlin | |
| 6,131,540 | A | 10/2000 | Bronkal | |
| 6,279,843 | B1 * | 8/2001 | Coldren et al. | 239/585.1 |
| 6,298,829 | B1 | 10/2001 | Welch et al. | |
| 6,508,418 | B1 | 1/2003 | Fochtman et al. | |
| 6,564,777 | B2 | 5/2003 | Rahardja et al. | |
| 6,584,958 | B2 | 7/2003 | Rahardja et al. | |
| 7,048,209 | B2 | 5/2006 | Czimmek | |
| 7,216,632 | B2 | 5/2007 | Nagatomo et al. | |
| 7,363,914 | B2 | 4/2008 | Hoffmann et al. | |
| 2006/0214033 | A1 * | 9/2006 | Koyanagi et al. | 239/585.1 |
| 2007/0289578 | A1 | 12/2007 | Ricco et al. | |
| 2008/0036564 | A1 | 2/2008 | Henry et al. | |

* cited by examiner

*Primary Examiner* — Darren W Gorman
(74) *Attorney, Agent, or Firm* — Liell & McNeil

(57) ABSTRACT

A fuel injector for a common rail fuel system includes a common rail inlet port fluidly connected to a high pressure common rail, and a cooling inlet fluidly connected to an output from a lower pressure fuel transfer pump. The cooling fluid circulates internally through the fuel injector to cool a single pole solenoid via both internal and peripheral cooling passages. In order to accommodate a small spatial envelope while providing superior performance, a thin insulating layer may separate the solenoid coil winding from an inner pole piece, and small flux gap clearances may permit a flux carrying portion of the injector body to be a portion of the single pole solenoid assembly.

15 Claims, 3 Drawing Sheets

STATOR ASSEMBLY AND FUEL INJECTOR USING SAME

TECHNICAL FIELD

The present disclosure relates generally to solenoid features of fuel injectors for common rail fuel systems, and more particularly to a cooled solenoid assembly with performance enhancing space saving features.

BACKGROUND

Common rail fuel systems have shown considerable promise in providing the versatility necessary to improve performance while also reducing undesirable emissions, especially in relation to compression ignition engines. As the industry demands ever higher injection pressures, more problems have begun to reveal themselves. Among these problems may be a need to cool an internal electrical actuator, such as a solenoid or piezo, in order to maintain the electrical actuator in a temperature range that maintains high actuation forces coupled with fast response times. In some applications, especially those having electrical actuator spatial constraints, maintaining and improving actuator performance can be problematic. For instance, in many applications, one or more electrical actuators must be totally contained within an injector body, and a certain proportion of the electrical actuator, especially in the case of solenoids, must normally be occupied by insulating material. Thus, in the case of solenoid actuators, maintaining or improving flux transfer while also reducing the volume of material associated with insulating properties can be problematic. Prior art solenoid assemblies for fuel injectors typically include a pole piece upon which is mounted a plastic bobbin that carries the solenoid coil winding. Because the winding is typically wound onto the bobbin before attachment to the pole piece, the bobbin must have sufficient structural integrity to undergo the winding process. The end result might be more material volume being associated with the bobbin than might otherwise be needed for proper operation after the solenoid is installed.

In a typical fuel injector application, a solenoid actuator is coupled to a valve member to open and close one or more fluid passages to facilitate a fuel injection event. Two types of solenoids have appeared in the art. One type is identified as a dual pole solenoid and often is characterized by the fact that the peripheral edges of the armature have a diameter larger than the outer diameter of the coil winding. The armature moves between an initial air gap position and a final axial air gap position with regard to a stator. In another type, a so called single pole solenoid includes not only an axial air gap but a sliding air gap within which the armature moves. One such example is shown, for instance, in Coltec Industries Inc.'s U.S. Pat. No. 4,984,549 to Mesenich. Single pole solenoids are often identified by their armature peripheral edge having a sliding flux gap with a magnetic flux carrying member, and the diameter of the armature is typically smaller than the inner diameter of the coil winding. Regardless of the solenoid type, the flux transfer capability of the solenoid assembly, and hence the speed and responsiveness of the associated valve, can deteriorate substantially as temperatures increase beyond a certain level depending upon the solenoid structure and materials used. Increased temperatures can be attributed to leakage within the fuel injector, repeated actuation events, and even the transfer of temperature from the combustion chamber of the engine through other fuel injector components.

Another important feature that affects the performance of solenoids relates to the size of air gaps that separate the moving armature from stationary magnetic flux carrying components of the solenoid assembly. While smaller air gaps may facilitate better flux transfer, geometrical variations in component parts may make mass production of solenoid assemblies with uniform air gaps that yield consistent behavior illusive. For instance, maintaining smaller air gaps often requires the armature to be guided in its motion, such as via attachment to a valve member which moves in a guide clearance bore. However, geometrical tolerance stack-ups may limit the realistic air gaps available with such a strategy.

The present disclosure is directed toward one or more of the problems set forth above.

SUMMARY

In one aspect, a fuel injector includes an injector body that defines a nozzle outlet, a cooling inlet and a drain outlet. A solenoid assembly is disposed inside the injector body and includes a stator assembly, which has at least one pole piece that defines a cooling passage extension extending therethrough. A cooling path includes the cooling passage and extends between the cooling inlet and the drain outlet.

In another aspect, a fuel injector includes an injector body that defines a nozzle outlet and includes a flux carrying portion. A single pole solenoid assembly is disposed in the injector body and includes a stator assembly, an armature assembly, a flux ring component and the flux carrying portion of the injector body. The armature assembly includes a stem and an armature having a top armature surface and a side armature surface. A stator assembly has a bottom stator surface that includes an inner pole and an outer pole. A flux gap is defined between the outer pole of the stator assembly and the flux carrying portion of the injector body. An initial axial air gap is defined between the top armature surface of the armature and the bottom stator surface of the stator assembly when the armature is at a first armature position. A sliding air gap is defined between the side armature surface and the flux ring component of the solenoid assembly. The flux gap and the sliding air gap are smaller than the initial axial air gap.

In still another aspect, a stator assembly for a solenoid includes an insulating layer positioned between a metallic pole piece and a solenoid coil winding. The insulating layer has a thickness less than 400 microns.

DETAILED DESCRIPTION

Figure 1:
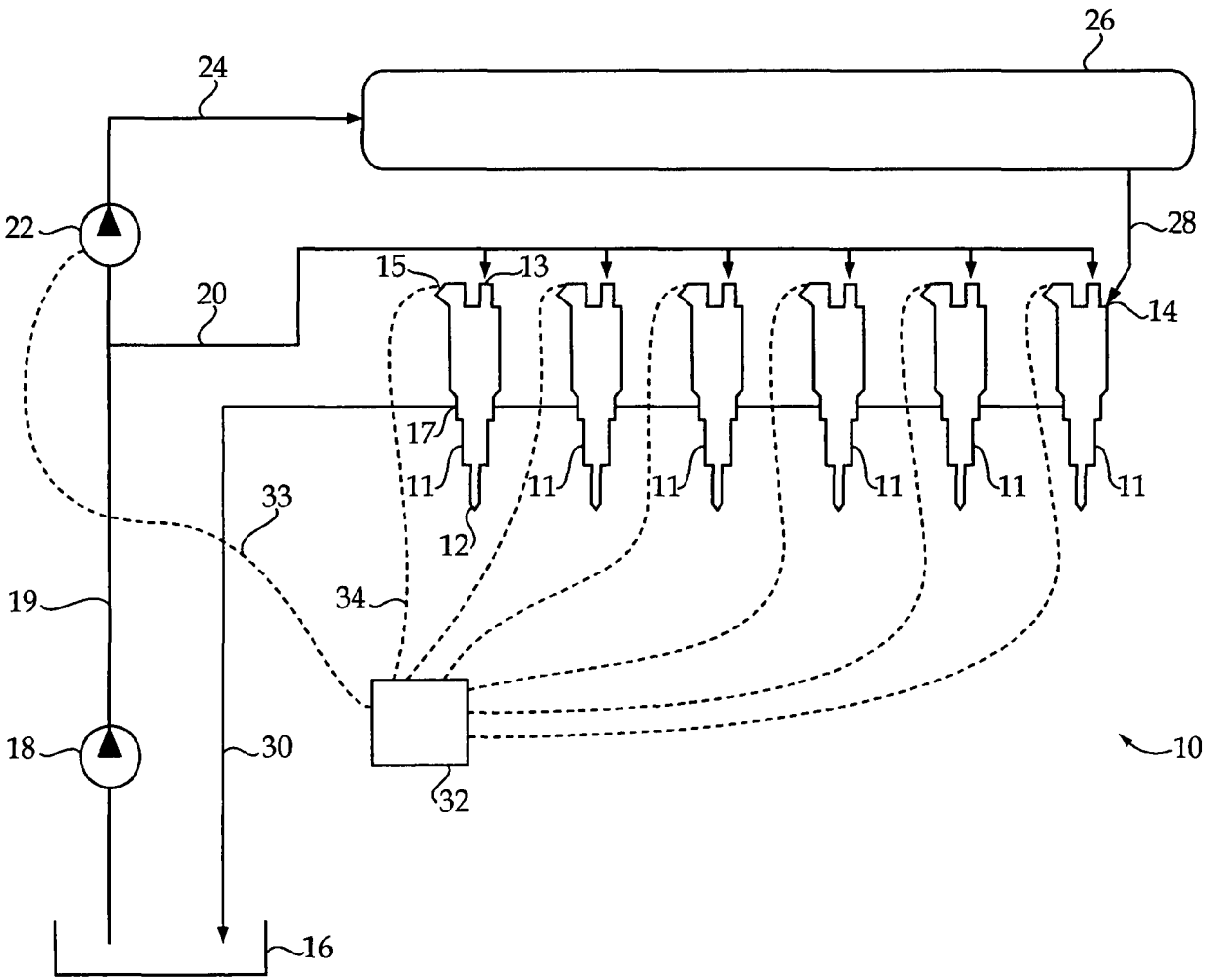
FIG. 1 is a schematic illustration of a common rail fuel system according to one aspect of the present disclosure.

Referring to FIG. 1, a common rail fuel injection system 10 includes a plurality of fuel injectors 11 positioned for direct injection into individual cylinders (not shown) of an internal combustion engine. For instance, FIG. 1 shows six fuel injectors 11 positioned for direct injection by including a nozzle outlet 12 of each fuel injector 11 located in an individual cylinder (not shown) of a compression ignition engine. Each fuel injector 11 also includes a high pressure rail inlet 14 fluidly connected to a common rail 26 via an individual branch passage 28, only one of which is shown. In addition, each fuel injector 11 includes a cooling inlet 13 fluidly connected to a fuel cooling line 20. A low pressure fuel transfer pump 18 supplies fuel via a fuel circulation line 19 to the fuel cooling line 20, and to a high pressure pump 22, which supplies high pressure fuel to common rail 26 via a high pressure supply line 24. Each fuel injector 11 also includes a drain outlet 17 fluidly connected to fuel tank 16 via a drain return line 30. The fuel transfer pump 18 is supplied with fuel from fuel tank 16 in a conventional manner.

Fuel system 10 is controlled by an electronic controller 32, which may take the form of an electronic control module with a standard design and generally include in a processor, such as for example a central processing unit, a memory, and a input/output circuit that facilitate communication internal and external to electronic controller 32. The central processing unit controls operation of the electronic control module by executing operating instructions, such as, for example, programming code stored in memory, wherein operations may be initiated internally or externally to the electronic control module. A control scheme may be utilized that monitors outputs of systems or devices, such as, for example sensors, actuators or control units, via the input/output circuit to control inputs to various other systems or devices. For instance, the electronic controller 32 may be in control communication with each of the fuel injectors 11 via a communication line 34 connected to a solenoid connector 15. In addition, the pressure in common rail 26 is controlled via a communication line 33 that connects to an appropriate electrical actuator(s) associated with high pressure pump 22. The memory of electronic controller 32 may comprise temporary storage areas, such as, for example, cache, virtual memory, or random access memory, or permanent storage areas, such as, read only memory, removable drives, network/internet storage, hard drives, flash memory, memory sticks or any other known volatile or non-volatile data storage devices located internally or externally to the electronic control module. Alternatively, or in addition, electronic controller 32 may include dedicated circuitry to perform some function as opposed to a program code executed on a central processing unit.

Figure 2:
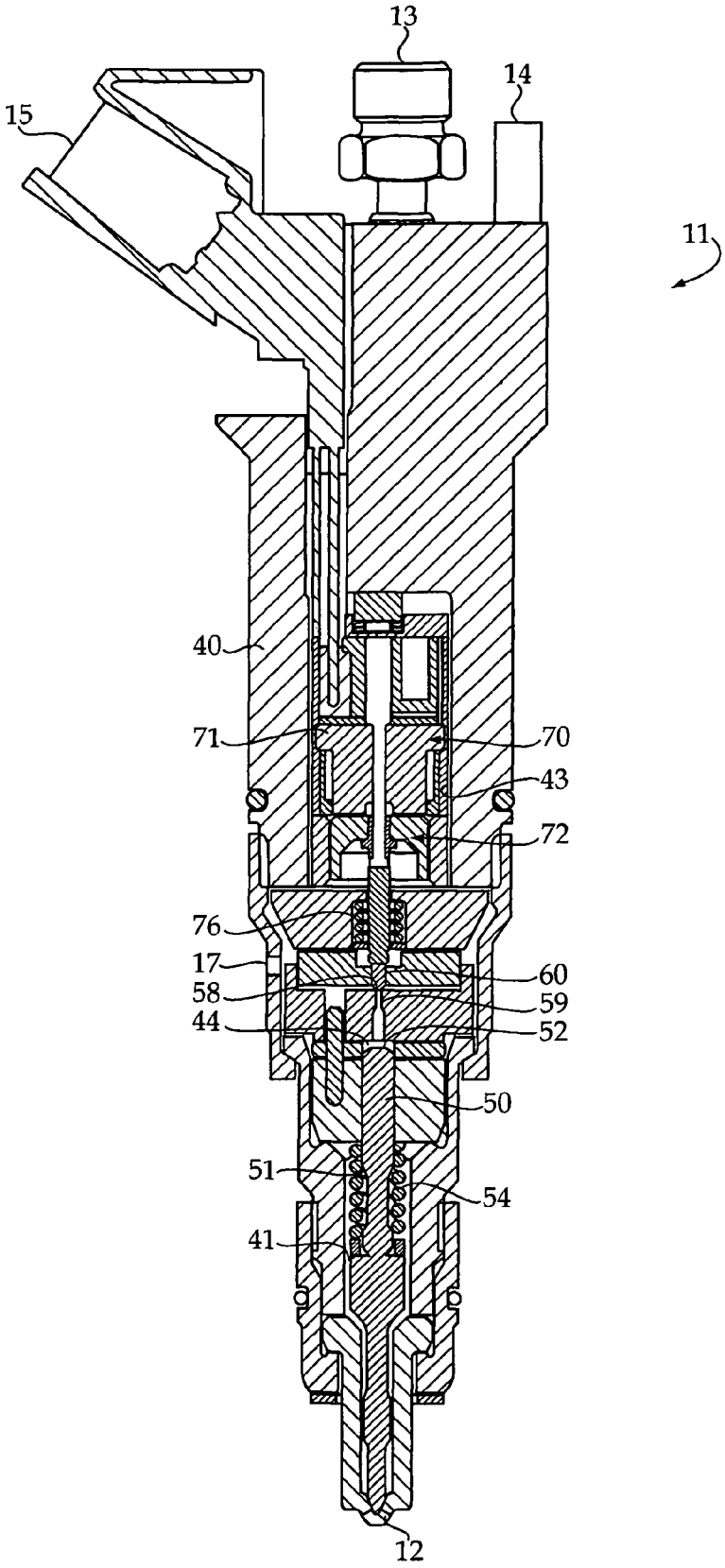
FIG. 2 is a side sectioned diagrammatic view of a fuel injector for the fuel system of FIG. 1.
Figure 4:
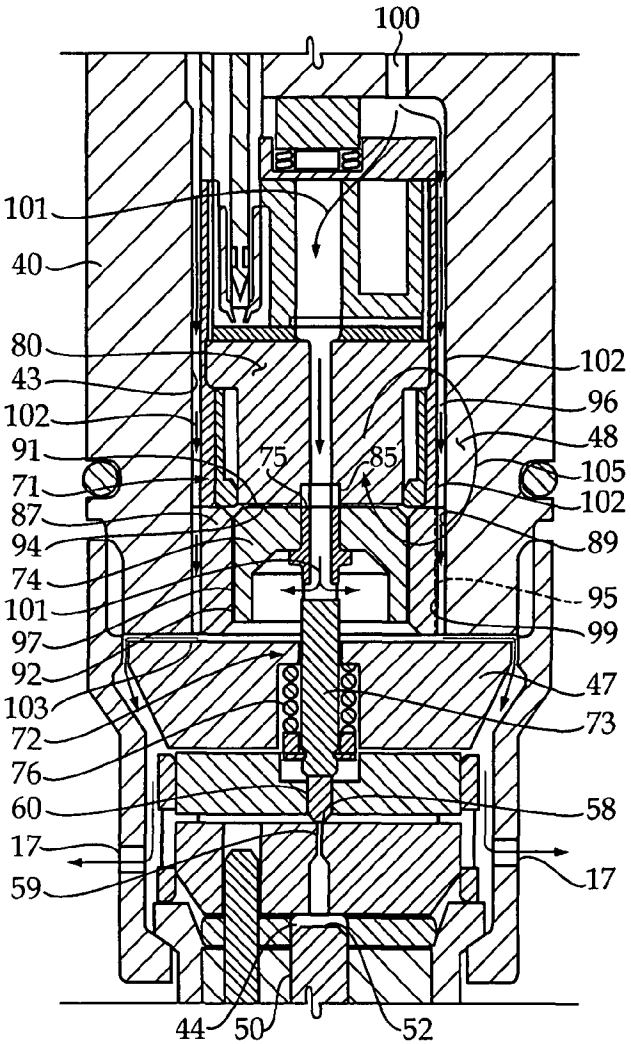
FIG. 4 is an enlarged sectioned side diagrammatic view of the solenoid assembly and control valve portions of the fuel injector shown in FIG. 2.

Referring to FIGS. 2 and 4, each fuel injector 11 includes an injector body 40 and a nozzle chamber 41 fluidly connected to nozzle outlet 12, which is defined by the injector body, when a needle valve member 50 is lifted to an open position. Nozzle chamber 41 is fluidly connected to high pressure rail inlet port 14 via an internal passage (not shown) through injector body 40. The needle valve member 50 is normally biased toward a closed position by a biasing spring 54. Needle valve member 50 includes an opening hydraulic surface 51 that is exposed to fluid pressure in nozzle chamber 41, which is always in fluid communication with common rail 26 (FIG. 1), and includes a closing hydraulic surface 52 exposed to fluid pressure in a needle control chamber 44. Needle control chamber 44 may be fluidly connected to nozzle chamber 41 via a passage not shown. Fuel injector 11 also includes a solenoid assembly 70 that is operably coupled to move a control valve member 60. When solenoid assembly 70 is de-energized, a biasing spring 76 biases an armature assembly 72 downward to push valve member 60 to close a flat seat 58, and hence close a pressure release orifice 59. Thus, when solenoid assembly 70 is de-energized, high pressure from rail 26 (FIG. 1), prevails in both nozzle chamber 41 and needle control chamber 44 resulting in needle valve member 50 being biased toward its closed position by biasing spring 54. When solenoid assembly 70 is energized, armature assembly 72 moves upward to allow valve member 60 to move off of flat seat 58 to fluidly connect needle control chamber 44 to low pressure drain outlet 17 via pressure release orifice 59 and an intervening fluid passage that can not be seen in the sectioned view of FIG. 2. When the flat seat is opened, pressure drops in needle control chamber 44 allowing the hydraulic force acting on opening hydraulic surface 51 to overcome biasing spring 54 to lift needle valve member 50 upward to open nozzle outlet 12 to commence a fuel injection event. The fuel injection event is ended by the then de-energized solenoid assembly 70 to again push valve member 60 to close flat seat 58 and resume high pressure in needle control chamber 44.

In the illustrated embodiment, solenoid assembly 71 is a single pole solenoid assembly that includes a stator assembly 70 and an armature assembly 72. However, those skilled in the art will appreciate the alternative embodiments may include a dual pole solenoid as an alternative to the structure illustrated without departing from the present disclosure. Recalling, an alternative dual pole solenoid includes no sliding air gap between its armature and stator, and typically does not include a flux ring.

Figure 3:
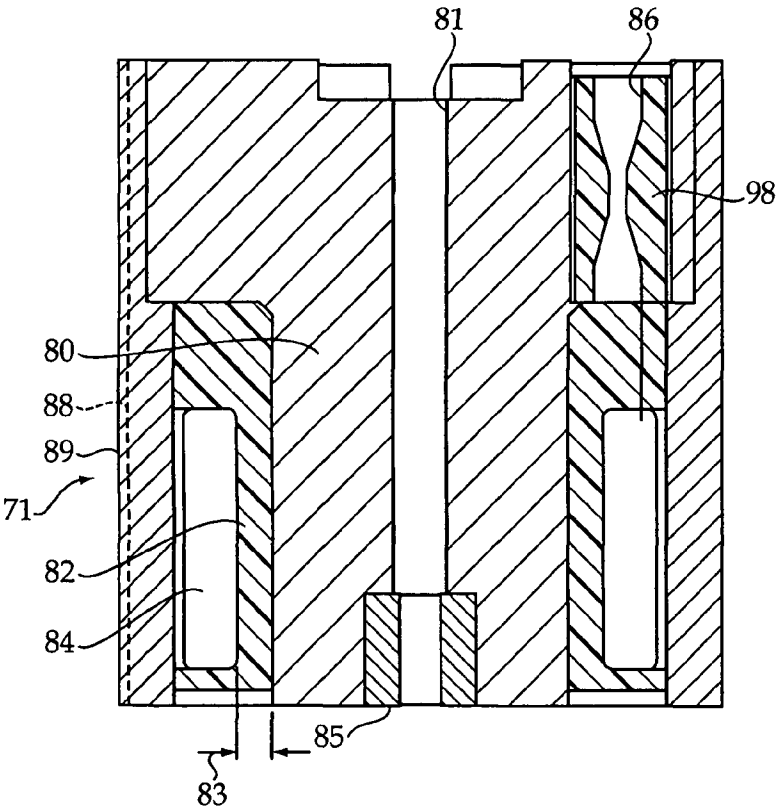
FIG. 3 is a side sectioned view of a stator assembly according to one aspect of the present disclosure.

Referring now to FIG. 3, a detailed view of the stator assembly 71 from the fuel injector 11 of FIG. 2 is illustrated. Stator assembly 71 includes an inner pole piece 80 that defines an inner pole cooling passage 81 that extends vertically therethrough. In the event that inner pole piece 80 is manufactured from a relatively soft magnetic material, it might include a separate stator stop component 85 that may be press fit into the bottom portion of pole piece 80 and also define a portion of central cooling passage 81. Stator assembly 71 also includes insulating layer 82 that separates inner pole piece 80 from a solenoid coil winding 84. In the prior art, the insulating layer might be a plastic bobbin upon which the solenoid coil is wound. However, in the present disclosure the insulating layer 82 might be a relatively thin layer of plastic integrally molded onto inner pole piece 80. Thus, with the molding strategy, the solenoid coil winding 84 is wound onto the insulating layer after insulating layer has been molded onto inner pole piece 80 so that the inner pole piece provides the structural support to withstand the winding operation. Alternatively, insulating layer 82 could be an insulating coating produced by either shrink fitting a thin insulating tube onto inner pole piece 80, or possibly by spray coating an insulating layer onto the same. In any event, because the insulating layer 82 needs only insulate the solenoid coil winding from the inner pole piece 80, the insulating layer can have a relatively thin thickness 83, which may be less than 400 microns. This strategy allows for more of the volume of the stator assembly 71 to be occupied by either the inner pole piece 80 or the electrical winding 84, rather than being occupied with a relatively thick walled plastic bobbin as in the prior art. Stator assembly 71 also includes a pair of electric terminals 86, only one of which is shown, that are positioned in a bore defined by inner pole piece 80 and surrounded by insulating material while being electrically connected to solenoid coil winding 84. Electrical terminals 86 are electrically connected to solenoid connector 15 (FIG. 2) via electrical conductors (not shown) in a conventional manner. Electrical terminals 86 may take the form of socket connectors that better facilitate and ease assembly of fuel injector 11. In one version, the insulating layers separating terminals 86 from pole piece 80 may be the same material as insulating layer 82. For instance, the insulating layer surrounding the electrical terminals 86 may be plastic molded in the same molding process as that performed to mold insulating layer 82 to the inner pole piece 80. For instance, inner pole piece 80 may be used as a core in a plastic molding along with terminals 86 with the plastic molded around these components in a conventional plastic molding process. Thus, the insulating material 98 surrounding electrical terminals 86 might be the same as and be formed in the same process as the insulating layer 82. After the solenoid coil winding 84 is wound onto insulating layer 82, an outer pole 89 may be slid over to enclose the coil winding 84. Outer pole 89 may be of a magnetic material similar to that of inner pole piece 80, such as silicon iron or the magnetic material sold under the name SOMALOY. Although not necessary, outer pole 89 may include a plurality of angularly spaced apart flats 88 that cooling surfaces or partially define an outer pole cooling passage to facilitate the flow of cooling fluid along the peripheral outer surface of the stator assembly 71.

Referring now to FIG. 4, the stator assembly 71 of FIG. 3 is shown installed in the injector body of fuel injector 11. When installed, the solenoid assembly 70 includes stationary components and moving components. Among the stationary components are a stator assembly 71, a magnetic flux ring component 87 and a flux carrying portion 48 of the injector body. The movable components include an armature assembly 72 that includes a magnetic armature 74 attached to a relatively non-magnetic stem 73, such as via a press fit connection. When the solenoid assembly 70 is energized, the armature assembly 72 moves upward until stem stop surface 75 of stem 73 comes into contact with stator stop component 85. By including a relatively small flux gap 96 between outer pole 89 (FIG. 3) and an inner wall surface 43 of injector body 40, the flux carrying portion 48 may be considered part of the single pole solenoid assembly 70, since it acts to conduct some of the flux, such as that shown by flux path 105. Thus, the flux carrying portion 48 of the injector body 40 is itself utilized to increase the magnetic performance of solenoid assembly 70. The flux gap 96 may be on the order of a typical guide clearance. The solenoid assembly 70 also includes the flux ring component 87 that also may have a relatively tight guide clearance 99 with regard to the inner wall surface 43 to better facilitate the conduction of flux back from the flux carrying portion 48 of the injector body through flux ring component 87, back through armature 74 toward inner pole piece 80. Although not necessary, flux ring component 87 might include a plurality of angularly spaced cooling surfaces or flats 95 that could be considered outer pole cooling passages to facilitate creation of a peripheral fluid path 102 for a cooling fluid to circulate along the outer periphery of solenoid assembly 70.

When solenoid assembly 70 is de-energized, an initial axial air gap is defined between a top armature surface 91 of armature 74 and a bottom stator surface 94 of inner pole piece 80. This initial axial air gap may always be greater than the air gap 96 between outer pole 89 and injector body 40 as well as the second flux gap 99 between flux ring component 87 and injector body 40. When solenoid assembly 70 is energized and armature assembly 72 moves upward, the axial air gap between top armature surface 91 and bottom stator surface 94 is reduced but not eliminated completely. In other words, the stem 73 will come in contact with stator stop component 85 before the armature 74 actually contacts the inner pole piece 80. The final axial air gap may also be greater than the flux gaps 96 and 99 that separate outer pole 89 and flux ring component 87 from injector body 40 respectively. The motion of armature assembly 70 may be guided via a guide clearance that exists in the sliding air gap 97 that separates the side armature surface 92 from the inner surface of flux ring component 87. The magnitude of the sliding air gap guide clearance 97 may be on the same order as the magnitudes of the first and second flux gaps 96 and 99 identified previously. A magnitude of the same order means that none of the gaps is more than ten times the magnitude of the other gaps. Alternatively, the armature assembly 72 may be guided in its motion via a guide clearance interaction between stem 73 and another portion of injector body 40, such as a guide clearance interaction with valve spring plate 47, which is considered part of injector body 40. It should be noted that stem 73 may include a stem cooling passage 78 that forms part of internal cooling path 101.

Injector body 40 defines an internal cooling supply line 100 that is fluidly connected to cooling inlet 13. Cooling fluid travels through internal cooling supply line 100 and may take two paths through and around solenoid assembly 70 to provide cooling to the same. In particular, a portion of the cooling fluid may travel down through internal cooling path 101 whereas a second portion of the cooling fluid may travel on the outer surface of solenoid assembly 70 via a peripheral cooling path 102 that may be defined in part by the flats 95 on flux ring component 87 as well as the flats 88 formed on the outer surface of outer pole 89. Internal cooling and peripheral cooling paths 101 and 102 remerge toward the bottom of flux ring component 87 into merged cooling path 103 that directs the flow toward and out of injector body 40 to drain outlet 17.

INDUSTRIAL APPLICABILITY

The present disclosure finds potential application in any fuel injector, but finds specific application in common rail fuel injectors in which cooling may be an issue and space is at a premium. The fuel injector 11 according to the present disclosure has been illustrated as included several innovations, but a fuel injector containing only one of these innovations would also fall within the intended scope of the present disclosure. For instance, the fuel injector 11 includes a innovative stator assembly as shown in FIG. 3, but could include an alternative stator assembly without departing from the present disclosure. In addition, the present disclosure has been illustrated as including both internal and peripheral cooling paths to maintain a cooling function to regulate the temperature of the solenoid assembly 70. In some applications, no cooling may be necessary or one of the internal and external cooling paths 101 and 102 might be eliminated without departing from the present disclosure. Additional or alternatively located cooling passages would also fall within the intended scope of the disclosure. Finally, the fuel injector 11 includes an innovation that relies upon the injector body to assist in carrying flux and thus constitutes part of the solenoid assembly, whereas prior art fuel injectors typically isolate their solenoid assemblies from magnetic interaction with anything that could be fairly characterized as the injector body. In those applications with less space constraints, the utilization of the injector body for flux carrying purposes might be eliminated, as well as the space saving innovation in the stator assembly 71 that utilizes a relatively thin insulating layer between the coil winding 84 and the inner pole piece 80.

When common rail fuel system 10 is operating, the fuel transfer pump 18 generates enough fluid to meet the supply demands of high pressure pump 22 (i.e. the fuel injection demands) and the cooling demands of the individual fuel injectors 11. Any fuel pumped by fuel transfer pump 18 in excess of these demands will typically be recirculated back to tank 16 (via a passage not shown) in a conventional manner. Thus, cooling fluid continues to circulate through the individual fuel injectors 11 regardless of whether the fuel injector is being operated to perform a fuel injection event or during the relatively long periods between such events. In particular, the cooling fluid enters at cooling inlet 13, travels through an internal cooling supply line 100 where it splits in two from there the cooling fuel travels down through the center of solenoid assembly 70 via an internal cooling path 101 and also along the external surface of solenoid assembly 70 along peripheral cooling path 102. The cooling fluid paths 101 and 102 then emerge at merged cooling path 103, and shortly thereafter exit the fuel injector 11 at drain outlet 17 for a return to tank 16 via drain return line 30. Those skilled in the art will appreciate that the flow rate of cooling fluid circulating through fuel injectors 11 can be set to virtually any desired magnitude to accomplish appropriate temperature regulation goals associated with the operation of the solenoid assembly 70. It deserves noting that the cooling function is performed without utilization of fuel that has been raised to injection pressure levels by high pressure pump 22. Thus, the cooling function can be accomplished without wasting the energy necessary to pressurize the fuel for supply to the common rail 26.

Although the external cooling path 102 has been shown as being accomplished with flats formed on the outer surface of outer pole 89 and flux ring component 87, those skilled in the art will appreciate that alternate strategies could be utilized. For instance, grooves could be formed in the inner wall surface 43 of injector body 40 or on the outer surface of pole 89 and/or flux ring 87, or both to accommodate the peripheral cooling path 102. In addition, those grooves could be helical in shape or vertical. In addition, alternative grooves and/or flats could be formed other than in a vertical orientation on the external surfaces of outer pole 88 as well as flux ring component 87 without departing from the present disclosure.

The stator assembly 71 allows for potentially more magnetic force by decreasing the thickness of the insulating material layer that separates the solenoid coil winding 84 from the inner pole piece 80 relative to the prior art. The present disclosure contemplates a variety of methods for accomplishing a thin insulating layer, which need only be thick enough to accomplish the insulating purpose, and need not be relatively thick like prior art bobbins that must have the structural integrity sufficient to undergo a winding operation. In other words, the present disclosure contemplates a situation in which the inner pole piece 80 provides the structural support for the insulating layer 82 so that the winding procedure can be performed without distorting the shape of the insulating layer 82.

By utilizing the relatively thin insulating layer 82, more of the available spatial envelope can be utilized and occupied by magnetic material, such as inner pole piece 80, to increase the magnetic flux carrying capacity of the solenoid assembly 70 and maybe increase its response rate over a counterpart equivalent solenoid assembly that utilizes a prior art bobbin, winding strategy.

Another innovation illustrated in the fuel injector 11 of the present disclosure includes utilizing a flux carrying portion 48 of the injector body 40 as part of the solenoid assembly 70. This is accomplished by producing relatively small flux gaps 96 and 99 between the injector body 40 and outer pole 89 and the flux ring component 87, respectively, so that the flux path around the winding 84 travels from the inner pole piece 80, through the outer pole 89 across the air gap 96, through the flux carrying portion 48 of injector body 40, back across a second flux gap 99, through flux ring component 87, across the sliding air gap 97 between armature 74 and flux ring component 87, through armature 74, and across the axial air gap separating the top armature surface 91 from the bottom stator surface 94, then returning to the inner pole piece 80. This flux route is shown by flux path 105. Although injector body 40 may be made from a relatively harder metallic material than that typically associated with soft magnetic pole pieces, the extra flux carrying capacity provided by the injector body can further elevate the flux carrying capacity of solenoid assembly 70 to again elevate or maintain its response speed even in a relatively space constrained environment. In the illustrated embodiment, the energized and de-energized axial air gap between top armature surface 91 and bottom surface 94 may be greater than flux gaps 96 and 99 as well as sliding air gap 97. Although not necessary, a majority of the magnetic flux is carried directly form outer pole 89 to flux ring component, rather than via flux carrying portion 48 of injector body 40.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A fuel injector, comprising:

an injector body defining a nozzle outlet, a cooling inlet and a drain outlet;

a solenoid assembly, being disposed inside the injector body, and including a stator assembly;

the stator assembly including at least one pole piece;

the at least one pole piece defines a cooling passage extending therethrough;

a cooling path includes the cooling passage and extends between the cooling inlet and the drain outlet; and wherein the at least one pole piece includes an inner pole piece;

the cooling passage defined by the at least one pole piece being an inner pole cooling passage being defined by the inner pole piece;

a needle valve member with an opening hydraulic surface exposed to fluid pressure in a nozzle chamber and a closing hydraulic surface exposed to fluid pressure in a needle control chamber; and a control valve member operably coupled to be moved by the solenoid assembly to open and close the needle control chamber to the drain outlet.

2. A fuel injector, comprising:

an injector body defining a nozzle outlet, a cooling inlet and a drain outlet;

a solenoid assembly, being disposed inside the injector body, and including a stator assembly;

the stator assembly including at least one pole piece;

the at least one pole piece defines a cooling passage extending therethrough;

a cooling path includes the cooling passage and extends between the cooling inlet and the drain outlet;

wherein the at least one pole piece includes an inner pole piece;

the cooling passage defined by the at least one pole piece being an inner pole cooling passage being defined by the inner pole piece;

wherein the at least one pole piece further includes an outer pole;

the outer pole of the stator assembly includes a cooling surface;

the injector body including an inner wall surface;

an outer pole cooling passage being defined between the cooling surface and the inner wall surface of the injector body;

the cooling path further includes the outer pole cooling passage.

3. The fuel injector of claim 2 wherein:

at least one of the inner wall surface of the injector body and the cooling surface of the outer pole defines a plurality of vertical passageways distributed around an injector body centerline.

4. The fuel injector of claim 1 wherein the solenoid assembly includes an armature assembly having an armature and a stem;

the stem including a stem stop surface being in contact with a stator stop component of the stator assembly when the armature assembly is in an energized armature position;

the stem defining a stem cooling passage segment being fluidly connected to the cooling passage.

5. The fuel injector of claim 1 further includes a high pressure common rail fuel inlet port; and the cooling inlet is a low pressure fuel inlet.

6. The fuel injector of claim 1 wherein:

the at least one pole piece of the stator assembly being a metallic pole piece;

a solenoid coil winding wound around the metallic pole piece;

an insulating layer positioned between the metallic pole piece and the solenoid coil winding;

the insulating layer having a thickness of less than 400 microns, which is insufficient to structurally support the solenoid coil winding; and the metallic pole piece structurally supports the solenoid coil winding, but the insulating layer insulates the metallic pole piece from the solenoid coil winding.

7. The fuel injector of claim 2 wherein:

the injector body includes a flux carrying portion;

the solenoid assembly being a single pole solenoid assembly including the stator assembly, an armature assembly, a flux ring component and the flux carrying portion of the injector body;

the armature assembly including an armature having a top armature surface and a side armature surface;

the stator assembly having the inner pole piece with a bottom stator surface, and the outer pole;

a flux gap being defined between the outer pole of the stator assembly and the flux carrying portion of the injector body;

an initial axial air gap being defined between the top armature surface of the armature and the bottom stator surface of the stator assembly when the armature is at a de-energized armature position;

a sliding air gap being defined between the side armature surface and the flux ring component of the solenoid assembly;

the flux gap and the sliding air gap being smaller than the initial axial air gap.

8. The fuel injector of claim 7 wherein the flux ring component being positioned between the armature assembly and the injector body;

the flux gap being a first flux gap;

a second flux gap being defined between the flux carrying portion of the injector body and the flux ring component;

the first flux gap, the second flux gap and the sliding air gap being the same order of magnitude.

9. The fuel injector of claim 7 wherein:

the at least one pole piece of the stator assembly being a metallic pole piece;

a solenoid coil winding wound around the metallic pole piece;

an insulating layer positioned between the metallic pole piece and the solenoid coil winding; and the insulating layer having a thickness of less than 400 microns.

10. A fuel injector, comprising:

an injector body including a flux carrying portion and defining a nozzle outlet;

a single pole solenoid assembly, being disposed inside the injector body, and including a stator assembly, an armature, a flux ring component and the flux carrying portion of the injector body;

the armature having a top armature surface and a side armature surface;

the stator assembly having a bottom stator surface and including an inner pole and an outer pole;

a flux gap being defined between the outer pole of the stator assembly and the flux carrying portion of the injector body;

an initial axial air gap being defined between the top armature surface of the armature and the bottom stator surface of the stator assembly when the armature is at a de-energized armature position;

a sliding air gap being defined between the side armature surface and the flux ring component of the solenoid assembly;

the flux gap and the sliding air gap being smaller than the initial axial air gap.

11. The fuel injector of claim 10 wherein the injector body further defines a cooling inlet and a drain outlet;

the inner pole defines an inner pole cooling passage extending there through;

a cooling path includes the inner pole cooling passage and extends between the cooling inlet and the drain outlet.

12. The fuel injector of claim 11 further includes a common rail inlet port.

13. The fuel injector of claim 10 wherein the injector body includes an inner wall surface and the outer pole of the stator assembly includes a cooling surface;

at least one of the inner wall surface of the injector body and the cooling surface of the outer pole defines a plurality of vertical passageways distributed around an injector body centerline.

14. The fuel injector of claim 10 wherein the flux ring component being positioned between the armature and the injector body;

the flux gap being a first flux gap;

a second flux gap being defined between the flux carrying portion of the injector body and the flux ring component;

the first flux gap, the second flux gap and the sliding air gap being the same order of magnitude.

15. The fuel injector of claim 10 wherein:

the inner pole being a metallic pole piece;

a solenoid coil winding wound around the metallic pole piece;

an insulating layer positioned between the metallic pole piece and the solenoid coil winding; and the insulating layer having a thickness of less than 400 microns, which is insufficient to structurally support the solenoid coil winding; and the metallic pole piece structurally supports the solenoid coil winding, but the insulating layer insulates the metallic pole piece from the solenoid coil winding.

* * * * *